US011705080B2

(12) United States Patent
Liu et al.

(10) Patent No.: US 11,705,080 B2
(45) Date of Patent: Jul. 18, 2023

(54) VOLTAGE ADJUSTMENT METHOD AND ADJUSTMENT DEVICE FOR DISPLAY PANEL, AND DISPLAY DEVICE

(71) Applicants: Hefei BOE Display Technology Co., Ltd., Anhui (CN); BOE Technology Group Co., Ltd., Beijing (CN)

(72) Inventors: Rongcheng Liu, Beijing (CN); Huiming Wang, Beijing (CN)

(73) Assignees: HEFEI BOE DISPLAY TECHNOLOGY CO., LTD., Anhui (CN); BOE TECHNOLOGY GROUP CO., LTD., Beijing (CN)

( * ) Notice: Subject to any disclaimer, the term of this patent is extended or adjusted under 35 U.S.C. 154(b) by 12 days.

(21) Appl. No.: 17/038,529

(22) Filed: Sep. 30, 2020

(65) Prior Publication Data

US 2021/0097947 A1 Apr. 1, 2021

(30) Foreign Application Priority Data

Sep. 30, 2019 (CN) ..... 201910944167.6

(51) Int. Cl.
*G09G 3/36* (2006.01)

(52) U.S. Cl.
CPC ..... *G09G 3/3607* (2013.01); *G09G 3/3696* (2013.01)

(58) Field of Classification Search
None
See application file for complete search history.

(56) References Cited

U.S. PATENT DOCUMENTS

2008/0024417 A1* 1/2008 Huang ..... G09G 3/3614 345/98
2013/0241967 A1* 9/2013 Nishimura ..... G09G 3/3648 345/89
2015/0187289 A1* 7/2015 Kim ..... G09G 3/3644 345/89
2016/0035277 A1* 2/2016 Han ..... G09G 3/3233 345/80
2016/0189656 A1* 6/2016 Park ..... G09G 3/006 345/694
2016/0269693 A1* 9/2016 Moriguchi ..... H04N 9/04557
2019/0305056 A1* 10/2019 Sonoda ..... H01L 27/3244
2021/0287613 A1* 9/2021 Liang ..... G09G 3/3291
2022/0051634 A1* 2/2022 Hong ..... G09G 3/3406

* cited by examiner

*Primary Examiner* — Benjamin C Lee
*Assistant Examiner* — Emily J Frank
(74) *Attorney, Agent, or Firm* — Nath, Goldberg & Meyer; Joshua B. Goldberg

(57) ABSTRACT

The disclosure provides a voltage adjustment method and a voltage adjustment device for a display panel, and a display device. The method includes: detecting whether an absolute value of a difference between a first gray scale data of a first sub pixel and a second gray scale data of a second sub pixel in a static picture area is larger than a preset gray scale threshold; if so, acquiring the first gray scale data; and inputting a target data voltage to the data line according to the first gray scale data, to adjust an original pixel voltage to the first sub pixel into a target pixel voltage and to cause an absolute value of a difference between a first voltage difference in the positive frame and a second voltage difference in the negative frame to be smaller than a preset voltage difference threshold.

20 Claims, 5 Drawing Sheets

VOLTAGE ADJUSTMENT METHOD AND ADJUSTMENT DEVICE FOR DISPLAY PANEL, AND DISPLAY DEVICE

CROSS-REFERENCE TO RELATED APPLICATIONS

The present application claims the priority of the Chinese Patent Application No. 201910944167.6, filed on Sep. 30, 2019, the content of which is incorporated herein by reference in its entirety.

TECHNICAL FIELD

The present disclosure relates to the field of display technology, and in particular, to a voltage adjustment method for a display panel, a voltage adjustment device for a display panel and a display device.

BACKGROUND

A liquid crystal display device with large size, high resolution and high refresh rate has been widely used with the development of liquid crystal display technology.

In a liquid crystal display panel, in order to prevent polarization of liquid crystal molecules, a pixel voltage input to a pixel electrode needs to be switched between a positive frame and a negative frame. For example, for two adjacent frames, a pixel voltage for the positive frame is input to a pixel electrode in one of the two adjacent frames, and a pixel voltage for the negative frame is input to the pixel electrode in the other one of the two adjacent frames, such that polarities of voltages applied to the liquid crystal molecules during a positive frame driving and during a negative flame driving are opposite to each other.

SUMMARY

According to one aspect of this disclosure, a voltage adjustment method for a display panel is provided, which includes: detecting whether an absolute value of a difference between a first gray scale data of a first sub pixel and a second gray scale data of a second sub pixel is larger than a preset gray scale threshold, wherein the first sub pixel and the second sub pixel are in a static picture area of an image to be displayed, and the first sub pixel and the second sub pixel are driven by a same data line and are arranged adjacent to each other; acquiring the first gray scale data when the absolute value of the difference between the first gray scale data of the first sub pixel and the second gray scale data of the second sub pixel is larger than the preset gray scale threshold; and inputting a target data voltage to the data line coupled to the first sub pixel according to the first gray scale data, so as to adjust an original pixel voltage to be theoretically charged to the first sub pixel into a target pixel voltage, and to cause an absolute value of a voltage difference between a first voltage difference of the first sub pixel in a positive frame and a second voltage difference of the first sub pixel in a negative frame, to be smaller than a preset voltage difference threshold; wherein the first voltage difference is an absolute value of a voltage difference between the target pixel voltage of the first sub pixel in the positive frame and a common voltage, and the second voltage difference is an absolute value of a voltage difference between the target pixel voltage of the first sub pixel in the negative frame and the common voltage.

Optionally, the inputting the target data voltage to the data line coupled to the first sub pixel according to the first gray scale data includes: adjusting one of the first gray scale data of the first sub pixel in the negative frame and the first gray scale data of the first sub pixel in the positive frame by taking the other one of the first gray scale data of the first sub pixel in the negative frame and the first gray scale data of the first sub pixel in the positive frame as a reference, so as to cause the absolute value of the voltage difference between the first voltage difference of the first sub pixel in the positive frame and the second voltage difference of the first sub pixel in the negative frame, to be smaller than the preset voltage difference threshold.

Optionally, inputting the target data voltage to the data line coupled to the first sub pixel according to the first gray scale data further includes: acquiring a target gray scale data of the first sub pixel in the negative frame according to the first gray scale data of the first sub pixel in the negative frame; and inputting a target data voltage of the first sub pixel in the negative frame, corresponding to the target gray scale data of the first sub pixel in the negative frame to the data line coupled to the first sub pixel; wherein an original data voltage of the first sub pixel in the negative frame corresponding to the first gray scale data of the first sub pixel in the negative frame is not equal to the target data voltage of the first sub pixel in the negative frame.

Optionally, the original data voltage of the first sub pixel in the negative frame corresponding to the first gray scale data of the first sub pixel in the negative frame is smaller than the target data voltage of the first sub pixel in the negative frame.

Optionally, the acquiring the target gray scale data of the first sub pixel in the negative frame according to the first gray scale data of the first sub pixel in the negative frame includes: acquiring a preset gray scale difference according to the first gray scale data of the first sub pixel in the negative frame, wherein the preset gray scale difference is a positive integer greater than 0; and subtracting the preset gray scale difference from the first gray scale data of the first sub pixel in the negative frame to acquire the target gray scale data of the first sub pixel in the negative frame.

Optionally, the acquiring the preset gray scale difference includes: acquiring a third voltage difference of the first sub pixel in the positive frame and a fourth voltage difference of the first sub pixel in the negative frame, wherein the third voltage difference is an absolute value of a voltage difference between the original pixel voltage of the first sub pixel in the positive frame and the common voltage, and the fourth voltage difference is an absolute value of a voltage difference between the original pixel voltage of the first sub pixel in the negative frame and the common voltage; determining a voltage difference between the first sub pixel in the positive frame and the first sub pixel in the negative frame, according to an absolute value of a voltage difference between the third voltage difference and the fourth voltage difference; and searching a corresponding preset gray scale difference from a preset gray scale table, according to the voltage difference between the first sub pixel in the positive frame and the first sub pixel in the negative frame; wherein the preset gray scale table includes: a one-to-one correspondence of voltage differences between the first sub pixel in the positive frame and the first sub pixel in the negative frame, and the preset gray scale differences corresponding to the voltage differences between the first sub pixel in the positive frame and the first sub pixel in the negative frame.

Optionally, the acquiring the preset gray scale difference further includes: acquiring the target data voltage of the first sub pixel in the negative frame, according to the voltage difference between the first sub pixel in the positive frame and the first sub pixel in the negative frame, and the original pixel voltage of the first sub pixel in the negative frame; determining the gray scale data corresponding to the target data voltage of the first sub pixel in the negative frame, according to correspondence relationship of voltage-gray-scale, based on the target data voltage of the first sub pixel in the negative frame; determining the gray scale data corresponding to the original pixel voltage of the first sub pixel in the negative frame, according to the correspondence relationship of voltage-grayscale, based on the original pixel voltage of the first sub pixel in the negative frame; and acquiring the preset gray scale difference according to the gray scale data corresponding to the original pixel voltage of the first sub pixel in the negative frame and the gray scale data corresponding to the target data voltage of the first sub pixel in the negative frame.

Optionally, the acquiring the third voltage difference of the first sub pixel in the positive frame and the fourth voltage difference of the first sub pixel in the negative frame includes: determining a first charging current according to a gate-source voltage of a driving transistor in the first sub pixel in the positive frame, and determining a second charging current according to the gate-source voltage of the driving transistor in the first sub pixel in the negative frame; and determining the third voltage difference of the first sub pixel in the positive frame according to the first charging current and a charging duration of the sub pixels in each row, and determining the fourth voltage difference of the first sub pixel in the negative frame according to the second charging current and the charging duration of the sub pixels in each row.

Optionally, the acquiring the third voltage difference of the first sub pixel in the positive frame and the fourth voltage difference of the first sub pixel in the negative frame includes: reading the third voltage difference of the first sub pixel in the positive frame output by an output terminal of a voltage detection circuit during a positive frame driving, and the fourth voltage difference of the first sub pixel in the negative frame output by the output terminal of the voltage detection circuit during a negative frame driving, wherein input terminals of the voltage detection circuit are respectively coupled to a pixel electrode and a common electrode.

According to one aspect of this disclosure, a voltage adjustment device for a display panel is provided, and includes a memory and a processor, wherein instructions are stored on the memory and executable on the processor, and when executed by the processor, the instructions cause the processor to perform a method comprising: detecting whether an absolute value of a difference between a first gray scale data of a first sub pixel and a second gray scale data of a second sub pixel is larger than a preset gray scale threshold, wherein the first sub pixel and the second sub pixel are in a static picture area of an image to be displayed, and the first sub pixel and the second sub pixel are driven by a same data line and are arranged adjacent to each other; acquiring the first gray scale data when the absolute value of the difference between the first gray scale data of the first sub pixel and the second gray scale data of the second sub pixel is larger than the preset gray scale threshold; and inputting a target data voltage to the data line coupled to the first sub pixel according to the first gray scale data, so as to adjust an original pixel voltage to be theoretically charged to the first sub pixel into a target pixel voltage, and to cause an absolute value of a voltage difference between a first voltage difference of the first sub pixel in a positive frame and a second voltage difference of the first sub pixel in a negative frame, to be smaller than a preset voltage difference threshold; wherein the first voltage difference is an absolute value of a voltage difference between the target pixel voltage of the first sub pixel in the positive frame and a common voltage, and the second voltage difference is an absolute value of a voltage difference between the target pixel voltage of the first sub pixel in the negative frame and the common voltage.

Optionally, the inputting the target data voltage to the data line coupled to the first sub pixel according to the first gray scale data includes: adjusting one of the first gray scale data of the first sub pixel in the negative frame and the first gray scale data of the first sub pixel in the positive frame by taking the other one of the first gray scale data of the first sub pixel in the negative frame and the first gray scale data of the first sub pixel in the positive frame as a reference, so as to cause the absolute value of the voltage difference between the first voltage difference of the first sub pixel in the positive frame and the second voltage difference of the first sub pixel in the negative frame, to be smaller than the preset voltage difference threshold.

Optionally, the inputting the target data voltage to the data line coupled to the first sub pixel according to the first gray scale data includes: acquiring a target gray scale data of the first sub pixel in the negative frame according to the first gray scale data of the first sub pixel in the negative frame; and inputting a target data voltage of the first sub pixel in the negative frame, corresponding to the target gray scale data of the first sub pixel in the negative frame to the data line coupled to the first sub pixel; wherein an original data voltage of the first sub pixel in the negative frame corresponding to the first gray scale data of the first sub pixel in the negative frame is not equal to the target data voltage of the first sub pixel in the negative frame.

Optionally, the original data voltage of the first sub pixel in the negative frame corresponding to the first gray scale data of the first sub pixel in the negative frame is smaller than the target data voltage of the first sub pixel in the negative frame.

Optionally, the when acquiring the target gray scale data of the first sub pixel in the negative frame according to the first gray scale data of the first sub pixel in the negative frame includes: acquiring a preset gray scale difference according to the first gray scale data of the first sub pixel in the negative frame, wherein the preset gray scale difference is a positive integer greater than 0; and subtracting the preset gray scale difference from the first gray scale data of the first sub pixel in the negative frame to acquire the target gray scale data of the first sub pixel in the negative frame.

Optionally, the acquiring the preset gray scale difference according to the first gray scale data of the first sub pixel in the negative frame includes: acquiring a third voltage difference of the first sub pixel in the positive frame and a fourth voltage difference of the first sub pixel in the negative frame, wherein the third voltage difference is an absolute value of a voltage difference between the original pixel voltage of the first sub pixel in the positive frame and the common voltage, and the fourth voltage difference is an absolute value of a voltage difference between the original pixel voltage of the first sub pixel in the negative frame and the common voltage; determining a voltage difference between the first sub pixel in the positive frame and the first sub pixel in the negative frame, according to an absolute value of a voltage difference between the third voltage difference and the fourth voltage difference; and searching a corresponding preset gray scale difference from a preset gray scale table, according to the voltage difference between the first sub pixel in the positive frame and the first sub pixel in the negative frame; wherein the preset gray scale table includes: a one-to-one correspondence of voltage differences between the first sub pixel in the positive frame and the first sub pixel in the negative frame, and preset gray scale differences corresponding to the voltage differences between the first sub pixel in the positive frame and the first sub pixel in the negative frame.

Optionally, the acquiring the preset gray scale difference according to the first gray scale data in the negative frame includes: acquiring the target data voltage of the first sub pixel in the negative frame, according to the voltage difference, between the first sub pixel in the positive frame and the first sub pixel in the negative frame, and the original pixel voltage of the first sub pixel in the negative frame; determining the gray scale data corresponding to the target data voltage of the first sub pixel in the negative frame, according to correspondence relationship of voltage-grayscale, based on the target data voltage of the first sub pixel in the negative frame; determining the gray scale data corresponding to the original pixel voltage of the first sub pixel in the negative frame, according to the correspondence relationship of voltage-grayscale, based on the original pixel voltage of the first sub pixel in the negative frame; and acquiring the preset gray scale difference according to the gray scale data corresponding to the original pixel voltage of the first sub pixel in the negative frame and the gray scale data corresponding to the target data voltage of the first sub pixel in the negative frame.

Optionally, the processor method further comprises: when acquiring the third voltage difference of the first sub pixel in the positive frame and the fourth voltage difference of the first sub pixel in the positive frame, determining a first charging current according to a gate-source voltage of a driving transistor in the first sub pixel in the positive frame, and determining a second charging current according to a gate-source voltage of the driving transistor in the first sub pixel in the negative frame; and determining the third voltage difference of the first sub pixel in the positive frame according to the first charging current and a charging duration of the sub pixels in each row, and determining the fourth voltage difference of the first sub pixel in the negative frame according to the second charging current and the charging duration of the sub pixels in each row.

Optionally, the acquiring the third voltage difference of the first sub pixel in the positive frame and the fourth voltage difference of the first sub pixel in the negative frame includes: reading the third voltage difference of the first sub pixel in the positive frame output by an output terminal of a voltage detection circuit during a positive frame driving, and the fourth voltage difference of the first sub pixel in the negative frame output by the output terminal of the voltage detection circuit during a negative frame driving, wherein input terminals of the voltage detection circuit are respectively coupled to a pixel electrode and a common electrode.

According to one aspect of this disclosure, a display device including a display panel and the voltage adjustment device for the display panel above.

Optionally, the display device further includes a driving circuit for driving the display panel to perform display.

DETAILED DESCRIPTION

Figure 1:
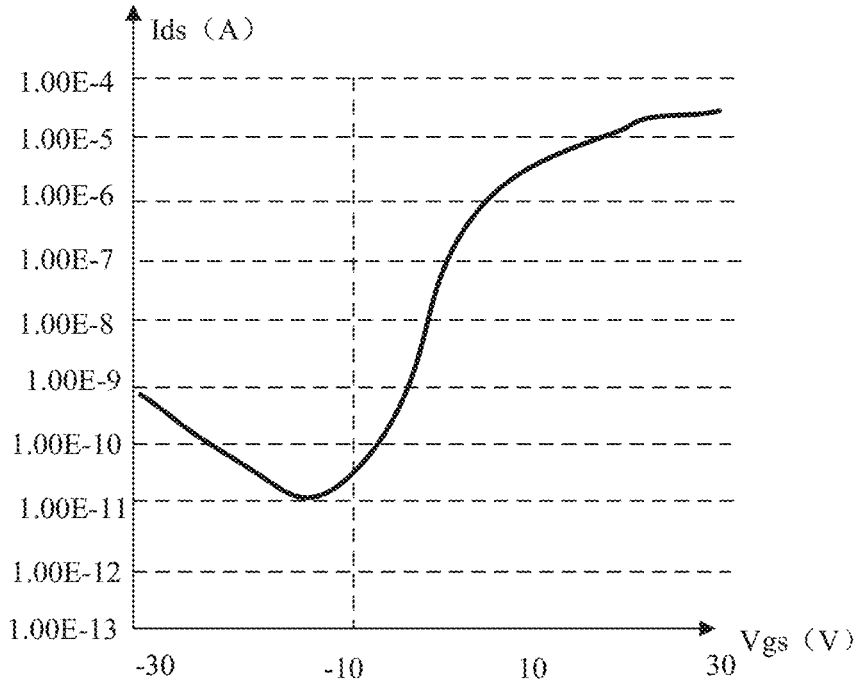
FIG. 1 illustrates a relationship between a gate-source voltage and a charging current of a driving transistor in a display panel.

The present disclosure will be described in further detail with reference to the drawings and the detailed description, so that a person skilled in the art will readily know the above objects, features and advantages of the disclosure.

A liquid crystal display panel includes a plurality of pixel units arranged in an array. Each of the plurality of pixel units includes at least one sub pixel. Each of the at least one sub pixel includes a pixel electrode, a common electrode and a liquid crystal layer between the pixel electrode and the common electrode. In addition, the liquid crystal display panel further includes a plurality of driving transistors. A gate of each of the plurality of driving transistors is coupled to a gate line, a source of each of the plurality of driving transistors is coupled to a data line, and a drain of each of the plurality of driving transistors is coupled to the pixel electrode of the sub pixel.

In order to prevent the polarization of the liquid crystal molecules, the pixel voltage input to the pixel electrode needs to be switched between a positive frame and a negative frame. For example, for two adjacent frames, the pixel voltage for the positive frame is input to the pixel electrode in one of the two adjacent frames, and the pixel voltage for the negative frame is input to the pixel electrode in the other one of the two adjacent frames, or for the sub pixels in two adjacent rows, the pixel voltage for the positive frame is input to the pixel electrodes in the sub pixels in one of the two adjacent rows, and the pixel voltage for the negative frame is input to the pixel electrodes in the sub pixels in the other one of the two adjacent rows.

In a current frame, when the driving transistor is turned on, the pixel voltage for the positive frame is input to the pixel electrode in the sub pixel through the data line, and then a current flows from the pixel electrode to the common electrode. When the current frame is switched to a next frame, the pixel voltage for the negative frame is input to the pixel electrode in the sub pixel through the data line, and then a current flows from the common electrode to the pixel electrode. Thus, the polarity of the voltages applied to the liquid crystal molecules during the positive frame driving and the polarity of the voltages applied to the liquid crystal molecules during the negative frame driving are opposite to each other.

Voltages corresponding to gray scale values Gray 255 and Gray 0 during the positive frame driving and during the negative frame driving are shown in table 1:

TABLE 1

| | positive frame driving | | negative frame driving | |
|---|---|---|---|---|
| Gray | Gray255 | Gray0 | Gray255 | Gray0 |
| Vg | 32 V | | 32 V | |
| Vs | 16 V | 9 V | 1 V | 8 V |
| Vgs | 16 V | 23 V | 31 V | 24 V |
| Vcom | 8.5 V | | 8.5 V | |
| VOTAGE DIFFERENCE | 7.5 V | 0.5 V | −7.5 V | −0.5 V |

Vg denotes a gate voltage input to the gate of the driving transistor through the gate line, Vs denotes a data voltage input to the source of the driving transistor through the data line, Vgs denotes a gate-source voltage of the driving transistor, Vcom denotes a common voltage applied to the common electrode, and the VOTAGE DIFFERENCE denotes a voltage difference between the pixel voltage applied to the pixel electrode and the common voltage applied to the common electrode.

It should be noted that the VOTAGE DIFFERENCE is substantially a voltage difference between the pixel voltage and the common voltage when the pixel electrode is fully charged. It can be seen that the absolute value of the voltage difference between the pixel voltage and the common voltage during the positive frame driving is equal to that during the negative frame driving, but the current during the positive frame driving flows in a direction opposite to that during the negative frame driving.

When the pixel electrode is not fully charged, the data voltage input to the sub pixel in the positive frame coupled to the data line during the positive frame driving is different from the data voltage input to the sub pixel in the negative frame coupled to the data line during the negative frame driving. For example, in a case that the sub pixel has a gray scale of Gray the data voltage from the data line coupled to the sub pixel in the positive frame is 16V and the data voltage from the data line coupled to the sub pixel in the negative frame is 1V. Since both the gate voltage during the positive frame driving and the gate voltage during the negative frame driving are 32V, the gate-source voltage of the driving transistor during the positive frame driving is 16V, and the gate-source voltage of the driving transistor during the negative frame driving is 31V.

FIG. 1 illustrates a relationship between a gate-source voltage and a charging current of a driving transistor in a display panel, with an abscissa of the gate-source voltage Vgs of the driving transistor (per unit in V), and an ordinate of the charging current Ids (per unit in A) of the driving transistor. It can be seen that, when the gate-source voltage Vgs of the driving transistor is greater than 0, the gate-source voltage Vgs of the driving transistor has a positive correlation with the charging current Ids. When the gate-source voltage Vgs of the driving transistor during the positive frame driving is 16V and the gate-source voltage Vgs of the driving transistor during the negative frame driving is 31V, the charging current during the positive frame driving is smaller than the charging current during the negative frame driving. The higher the charging current is, the shorter the time required to fully charge the pixel electrode is, and the smaller the charging current is, the longer the time required to fully charge the pixel electrode is.

Figure 2:
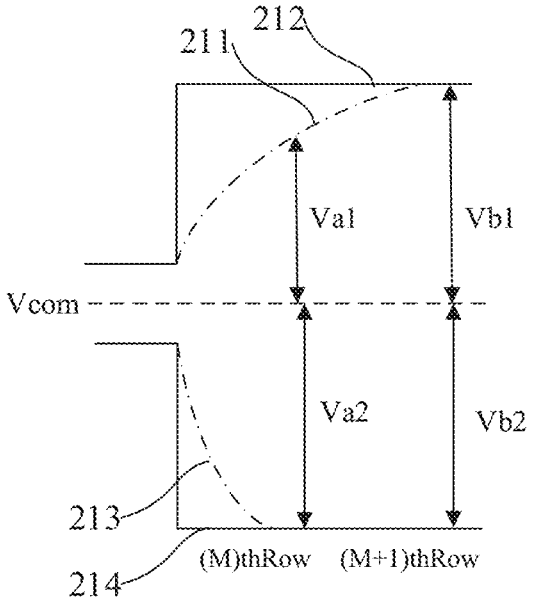
FIG. 2 is a schematic diagram illustrating that an original pixel voltage in a positive frame and an original pixel voltage in a negative frame are asymmetric with respect to a common voltage in a display panel.

As shown in FIG. 2, the pixel voltage actually charged to the pixel electrode of the sub pixel during the positive frame driving refers to 211 as the original pixel voltage in the positive frame, and the data voltage from the data line coupled to the sub pixel during the positive frame driving refers to 212 as the original data voltage in the positive frame. The pixel voltage actually charged to the pixel electrode of the sub pixel during the negative frame driving refers to 213 as the original pixel voltage in the negative frame, and the data voltage from the data line coupled to the sub pixel during the negative frame driving refers to 214 as the original data voltage in the negative frame. It can be seen that, the time required to charge the pixel electrode to the original data voltage in the positive frame during the positive frame driving is greater than the time required to charge the pixel electrode to the original data voltage in the negative frame during the negative frame driving.

As shown in FIG. 2, for the sub pixels in the (M)th row, when the pixel voltage of the sub pixel in the positive frame has not yet reached the original data voltage in the positive frame, the pixel voltage of the sub pixel in the negative frame at this time has reached the original data voltage in the negative frame, such that the original pixel voltage in the positive frame on the pixel electrode of the sub pixels in the (M)th row and the original pixel voltage in the negative frame on the pixel electrode of the sub pixels in the (M)th row are asymmetric with respect to the common voltage. That is, the absolute value Va1 of the voltage difference between the original pixel voltage in the positive frame in the (M)th row and the common voltage during the positive frame driving is not equal to the absolute value Va2 of the voltage difference between the original pixel voltage in the negative frame in the (M)th row and the common voltage during the negative frame driving.

There is a large deviation between the absolute values Va1 and Va2, which is a DC component. When a same static picture is displayed on the liquid crystal display panel for a long time, the DC component will be applied to the liquid crystal molecules of the liquid crystal display panel for a long time, which will easily result in a residual image on the liquid crystal display panel.

It should be noted that, the pixel voltage of the sub pixel in the positive frame in the (M+1)th row may reach the original data voltage in the positive frame, and thus the original pixel voltage in the positive frame on the pixel electrode of the sub pixel in the (M+1)th row and the original pixel voltage in the negative frame on the pixel electrode of the sub pixel in the (M+1)th row are symmetrical with respect to the common voltage. That is, the absolute value Vb1 of the voltage difference between the original pixel voltage of the sub pixel in the positive frame in the (M+1)th row and the common voltage during the positive frame driving is equal to the absolute value Vb2 of the voltage difference between the original pixel voltage of the sub pixel in the negative frame in the (M+1)th row and the common voltage during the negative frame driving.

Figure 3:
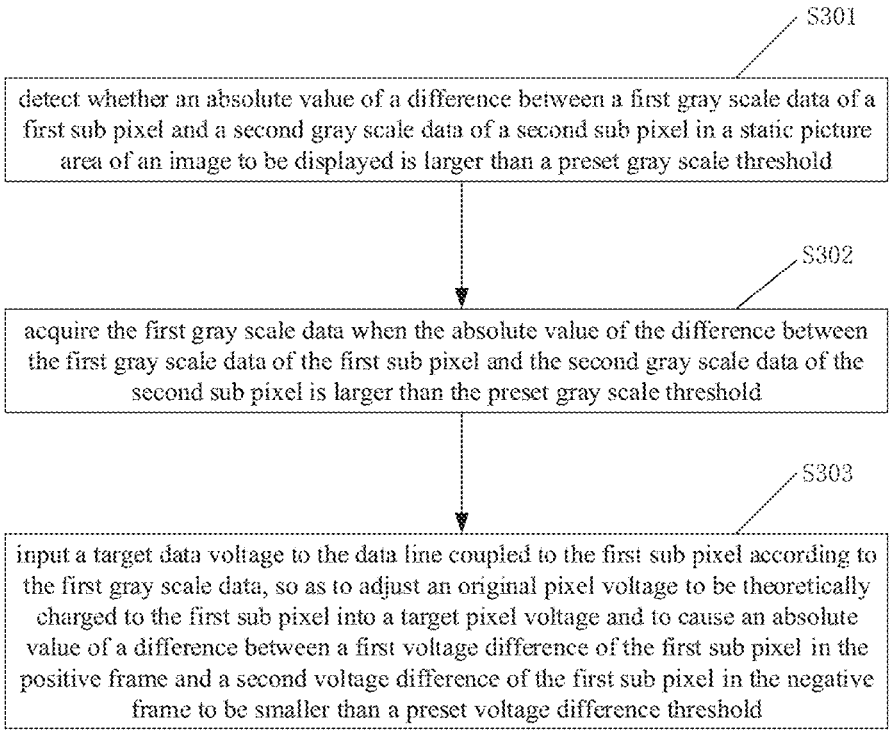
FIG. 3 is a flow chart of a voltage adjustment method according to an embodiment of the present disclosure.

Referring to FIG. 3, a flow chart of a voltage adjustment method according to an embodiment of the present disclosure is shown, and may specifically include the following steps.

In step 301, whether an absolute value of a difference between a first gray scale data of a first sub pixel and a second gray scale data of a second sub pixel is larger than a preset gray scale threshold is detected. The first sub pixel and the second sub pixel are in a static picture area of an image to be displayed.

Figure 4:
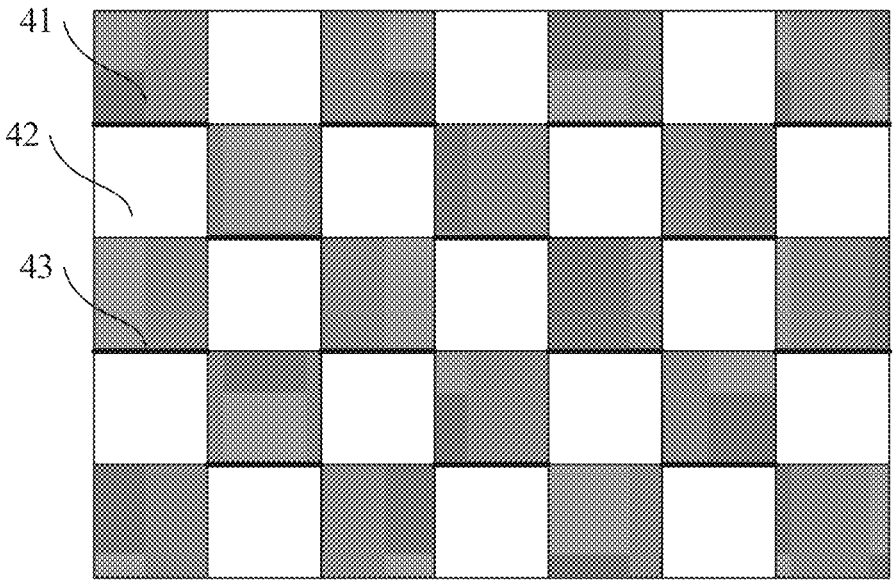
FIG. 4 is a schematic diagram of an image to be displayed according to an embodiment of the disclosure.

In the embodiment of the present disclosure, firstly, the image to be displayed is acquired, and the image to be displayed may be a static image displayed on the display panel for a long time. As shown in FIG. 4, the image to be displayed may be a black-white checkerboard image. The black-white checkerboard image including a black area 41 and a white area 42 is displayed on the display panel for a long time during a residual image test. Of course, the image to be displayed may also be an image that changes constantly on the display panel, while there are one or more static picture areas in the image to be displayed. The one or more static picture areas may remain for a long time without being changed when being displayed on the display panel.

Since the residual image generally appears in the static picture area displayed for a long time, the detection that whether the absolute value of the difference between the first gray scale data of the first sub pixel and the second gray scale data of the second sub pixel in the static picture area of the image to be displayed is greater than the preset gray scale threshold refers to the detection that whether the abrupt change in the gray scale exists in the static picture area. In the present disclosure, the first sub pixel and the second sub pixel are driven by a same data line and are arranged adjacent to each other, i.e. usually the first sub pixel and the second sub pixel are located in a same column. For example, the first sub pixel is located in a row right behind the row where the second sub pixel is located.

As shown in FIG. 4, the gray scale in the black-white checkerboard image changes abruptly at position 43, where the gray scale data changes abruptly from Gray 0 to Gray 255, i.e. from the second gray scale data of the second sub pixel to the first gray scale data of the first sub pixel. The second sub pixel may be located in the (M−1)th row and the (K)th column, and the first sub pixel may be located in the (M)th row and the (K)th column, where M and K are positive integers greater than 1. The first gray scale data of the first sub pixel may be 255, and the second gray scale data of the second sub pixel may be 0. As for the first sub pixel, the original data voltage in the positive frame from the data line is required to change from 9V to 16V during the positive frame driving, and the original data voltage in the negative frame from the data line is required to change from 8V to 1V during the negative frame driving. Since the charging current during the positive frame driving is smaller than that during the negative frame driving, the original pixel voltage in the positive frame on the pixel electrode of the first sub pixel in the (M)th row and the original pixel voltage in the negative frame on the pixel electrode of the first sub pixel in the (M)th row are asymmetric with respect to the common voltage. Since the first sub pixel in the (M)th row is located in the static picture area, the residual image tends to appear in the first sub pixel in the (M)th row.

Of course, in practice, the position where the residual image appears is not limited to the first sub pixel in the (M)th row. Due to the influence of the driving capability of the driving circuit and the driving transistor and the RCdelay (resistance capacitance delay), the residual image may appear at any adjacent sub pixels having the gray scale abrupt change and driven by the same data line, especially at two adjacent sub pixels where the first sub pixel has a high gray scale and the second sub pixel has a low gray scale.

It should be noted that, the first gray scale data is not limited to 255, and the second gray scale data is not limited to 0, as long as the absolute value of the difference between the first gray scale data and the second gray scale data is ensured to be greater than the preset gray scale threshold. The preset gray scale threshold may be determined empirically, for example, by setting the preset gray scale threshold to 127, the first gray scale data to 240, and the second gray scale data to 20.

In step 302, when the absolute value of the difference between the first gray scale data of the first sub pixel and the second gray scale data of the second sub pixel is larger than the preset gray scale threshold, the first gray scale data is acquired.

In the embodiment of the present disclosure, when the absolute value of the difference between the first gray scale data of the first sub pixel and the second gray scale data of the second sub pixel in the static picture area is larger than the preset gray scale threshold, that is, there is a gray scale abrupt change in the static picture area, the residual image is determined to appear in the static picture area of image to be displayed, and the first gray scale data of the first sub pixel is acquired. That is, the gray scale data at the position where the residual image appears is acquired.

As shown in FIG. 4, the residual image appears at the position 43.

For example, the first gray scale data 255 of the first sub pixel in the (M)th row and the (K)th column is acquired.

In step 303, the driving circuit is controlled to input the target data voltage to the data line coupled to the first sub pixel according to the first gray scale data, so as to adjust the original pixel voltage to be theoretically charged to the first sub pixel into the target pixel voltage, and to cause the absolute value of the voltage difference between the first voltage difference of the first sub pixel in the positive frame and the second voltage difference of the first sub pixel in the negative frame, to be smaller than a preset voltage difference threshold.

In the embodiment of the present disclosure, according to the first gray scale data of the first sub pixel, the driving circuit is controlled to input the target data voltage to the data line coupled to the first sub pixel, that is, the original data voltage of the first sub pixel is adjusted to the target data voltage. The driving circuit inputs the target data voltage into the data line. In a case that the driving transistor is turned on, the target data voltage is input from the source of the driving transistor to the drain of the driving transistor, and accordingly, the original pixel voltage to be theoretically charged to the first sub pixel is adjusted to the target pixel voltage, such that the absolute value of the voltage difference between the first voltage difference of the first sub pixel in the positive frame and the second voltage difference of the first sub pixel in the negative frame is smaller than the preset voltage difference threshold. The first voltage difference is the absolute value of the voltage difference between the target pixel voltage in the positive frame and the common voltage, and the second voltage difference is the absolute value of the voltage difference between the target pixel voltage in the negative frame and the common voltage.

It should be noted that, the preset voltage difference threshold may be determined experimentally, the first sub pixel in the positive frame refers to the first sub pixel during the positive frame driving, and the first sub pixel in the negative frame refers to the first sub pixel during the negative frame driving. The target pixel voltage in the positive frame refers to the pixel voltage acquired by adjusting the original pixel voltage during the positive frame driving, and the target pixel voltage in the negative frame refers to the pixel voltage acquired by adjusting the original pixel voltage in the negative frame during the negative frame driving. The driving circuit may be a driving IC (Integrated Circuit) in practice.

In practice, the original data voltage of the first sub pixel in the positive frame may be adjusted to the target data voltage in the positive frame, thereby adjusting the original pixel voltage in the positive frame to the target pixel voltage in the positive frame, while the target pixel voltage in the negative frame is equal to the original pixel voltage in the negative frame. The original data voltage of the first sub pixel in the negative frame may also be adjusted to the target data voltage in the negative frame, thereby adjusting the original pixel voltage in the negative frame to the target pixel voltage in the negative frame, while the target pixel voltage in the positive frame is equal to the original pixel voltage in the positive frame.

Specifically, the step 303 may include step B1 and step B2.

In step B1, the target gray scale data is acquired according to the first gray scale data of the first sub pixel in the negative frame. For example, the first gray scale data in the negative frame may be adjusted to acquire the target gray scale data.

In step B2, the target gray scale data is sent to the driving circuit, so as to input the target data voltage in the negative frame by the driving circuit to the data line coupled to the first sub pixel. The original data voltage in the negative frame corresponding to the first gray scale data in the negative frame is not equal to the target data voltage in the negative frame. For example, in a case that the gray scale abrupt change appears when the first gray scale data is larger than the second gray scale data, and the charging current during the positive frame driving is smaller than that during the negative frame driving, the original data voltage in the negative frame corresponding to the first gray scale data in the negative frame is smaller than the target data voltage in the negative frame. That is, the absolute value of the original data voltage in the negative frame corresponding to the first gray scale data in the negative frame is larger than the absolute value of the target data voltage in the negative frame. The present disclosure is exemplified by taking the original data voltage in the negative frame corresponding to the first gray scale data in the negative frame, which is less than the target data voltage in the negative frame, as an example, but the present disclosure is not limited thereto.

In a specific embodiment of the present disclosure, the first gray scale data of the first sub pixel in the negative frame may be adjusted during the negative frame driving, to acquire the target gray scale data. Then, the target gray scale data is sent to the drive circuit. The driving circuit generates the target data voltage in the negative frame based on the target gray scale data, and then the original data voltage in the negative frame is adjusted to the target data voltage in the negative frame. Then, the target data voltage in the negative frame is input into the data line coupled to the first sub pixel, thereby adjusting the original pixel voltage to be charged theoretically to the first sub pixel into the target pixel voltage, such that the absolute value of the voltage difference between the first voltage difference of the first sub pixel in the positive frame and the second voltage difference of the first sub pixel in the negative frame is smaller than the preset voltage difference threshold.

Optionally, the absolute value of the voltage difference between the first voltage difference of the first sub pixel in the positive frame and the second voltage difference of the first sub pixel in the negative frame is equal to 0, such that the target pixel voltage of the first sub pixel in the positive frame and the target pixel voltage of the first sub pixel in the negative frame are symmetrical with respect to the common voltage.

Figure 5:
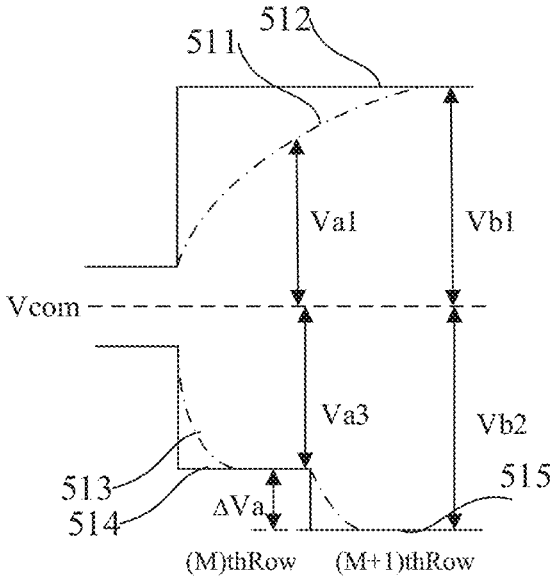
FIG. 5 a schematic diagram illustrating that a target pixel voltage in a positive frame and a target pixel voltage in a negative frame are symmetric with respect to a common voltage according to an embodiment of the present disclosure.

As shown in FIG. 5, the first gray scale data of the first sub pixel in the negative frame in the (M)th row and the (K)th column is 255. The first gray scale data 255 in the negative frame is adjusted to acquire the target gray scale data 200. The target gray scale data is sent to the driving circuit. The driver circuit generates the target data voltage 514 based on the target gray scale data. Then, the target data voltage 514 in the negative frame is input into the data line coupled to the first sub pixel in the (M)th row and the (K)th column, such that the original pixel voltage 213 to be theoretically charged to the first sub pixel in the (M)th row and the (K)th column is adjusted to the target pixel voltage 513 in the negative frame, such that the target pixel voltage 511 of the first sub pixel in the positive frame and the target pixel voltage 513 of the first sub pixel in the negative frame are symmetrical with respect to the common voltage. That is, the absolute value Va1 of the voltage difference between the target pixel voltage of the first sub pixel in the positive frame in the (M)th row and the common voltage during the positive frame driving is equal to the absolute value Va3 of the voltage difference between the target pixel voltage of the first sub pixel in the negative frame in the (M)th row and the common voltage during the negative frame driving. The target data voltage in the positive frame refers to 512, which is not adjusted and is equal to the original data voltage 212 in the positive frame. The target data voltage of the first sub pixel in the negative frame in the (M+1)th row and the (K)th column refers to 515, which is equal to the original data voltage 214 of the first sub pixel in the negative frame in the (M)th row and the (K)th column.

Specifically, the step B1 includes the following steps.

In step B11, the preset gray scale difference is acquired according to the first gray scale data. The preset gray scale difference is a positive integer greater than 0.

In step B12, the preset gray scale difference is subtracted from the first gray scale data in the negative frame to acquire the target gray scale data.

Firstly, the preset gray scale difference is acquired, which is a positive integer greater than 0. And then, the preset gray scale difference is subtracted from the first gray scale data in the negative frame to acquire the target gray scale data.

For example, if the preset gray scale difference is 55 and the first gray scale data of the first sub pixel in the negative frame in the (M)th row and the (K)th column is 255, the target gray scale data of the first sub pixel in the negative frame in the (M)th row and the (K)th column is 200.

Specifically, the step B11 specifically includes the following steps.

In step B111, the third voltage difference of the first sub pixel in the positive frame and the fourth voltage difference of the first sub pixel in the negative frame are acquired. The third voltage difference is the absolute value of the voltage difference between the original pixel voltage of the first sub pixel in the positive frame and the common voltage, and the fourth voltage difference is the absolute value of the voltage difference between the original pixel voltage of the first sub pixel in the negative frame and the common voltage.

In step B112, the voltage difference between the first sub pixel in the positive frame and the first sub pixel in the negative frame is determined according to the absolute value of the voltage difference between the third voltage difference and the fourth voltage difference.

In step B113, the corresponding preset gray scale difference is searched from the preset gray scale table according to the voltage difference. The preset gray scale table includes a one-to-one correspondence of voltage differences between the first sub pixel in the positive frame and the first sub pixel in the negative frame, and preset gray scale differences corresponding to the voltage differences between the first sub pixel in the positive frame and the first sub pixel in the negative frame.

In fact, the preset gray scale difference needs to be determined in advance. Firstly, before the original data voltage input to the data line coupled to the first sub pixel is adjusted, the third voltage difference Va1 of the first sub pixel in the positive frame and the fourth voltage difference Va2 of the first sub pixel in the negative frame are acquired. The third voltage difference is the absolute value of the voltage difference between the original pixel voltage of the first sub pixel in the positive frame and the common voltage, and the fourth voltage difference is the absolute value of the voltage difference between the original pixel voltage of the first sub pixel in the negative frame and the common voltage.

Then, the absolute value of the voltage difference between the third voltage difference Va1 and the fourth voltage difference Va2 is calculated to acquire the voltage difference ΔVa between the first sub pixel in the positive frame and the first sub pixel in the negative frame.

According to experimental measurement, when different voltages are respectively applied to the pixel electrode and the common electrode of the sub pixel, the gray scales of the sub pixel corresponding to the different voltages are measured, and the preset gray scale table is acquired. The gray scale table includes the voltage differences and the preset gray scale differences corresponding to the voltage differences in a manner of one to one correspondence. Specifically, the step of acquiring the preset gray scale difference further includes the following steps. Firstly, the target data voltage in the negative frame is acquired according to the voltage difference and the original pixel voltage in the negative frame. And then, the gray scale data corresponding to the target data voltage in the negative frame is determined according to the correspondence relationship of voltage-grayscale, based on the target data voltage in the negative frame. And then, the gray scale data corresponding to the original pixel voltage in the negative frame is determined according to the correspondence relationship of voltage-grayscale, based on the original pixel voltage in the negative frame. Finally, the preset gray scale difference is acquired according to the gray scale data corresponding to the original pixel voltage in the negative frame and the gray scale data corresponding to the target data voltage in the negative frame. The difference of the gray scale data corresponding to the original pixel voltage in the negative frame and the gray scale data corresponding to the target data voltage in the negative frame is the preset gray scale difference.

After the voltage difference ΔVa between the first sub pixel in the positive frame and the first sub pixel in the negative frame is acquired, the corresponding preset gray scale difference can be found from the preset gray scale table.

In an optional embodiment of the present disclosure, the step B111 specifically includes the following steps. Firstly, the first charging current is determined according to the gate-source voltage of the driving transistor in the first sub pixel in the positive frame, and the second charging current is determined according to the gate-source voltage of the driving transistor in the first sub pixel in the negative frame. Then, the third voltage difference of the first sub pixel in the positive frame is determined according to the first charging current and a charging duration of the sub pixels in each row, and the fourth voltage difference of the first sub pixel in the negative frame is determined according to the second charging current and a charging duration of the sub pixels in each row.

The third voltage difference of the first sub pixel in the positive frame and the fourth voltage difference of the first sub pixel in the negative frame can be determined by the relationship shown in FIG. 1. Each gale-source voltage Vgs of the driving transistor has a corresponding charging current. The first charging current is determined according to the gate-source voltage of the driving transistor in the first sub pixel in the positive frame, and the second charging current is determined according to the gate-source voltage of the driving transistor in the first sub pixel in the negative frame. Since the charging duration of each row of sub pixels can be predetermined, and the related parameters of an equivalent capacitance formed by the pixel electrode and the common electrode can also be predetermined, the third voltage difference of the first sub pixel in the positive frame may be acquired by inputting the first charging current and the charging duration of each row of sub pixels into a capacitance calculation formula, and the fourth voltage difference of the first sub pixel in the negative frame may be acquired by inputting the second charging current and the charging duration of each row of sub pixels into the capacitance calculation formula.

In another optional embodiment of the present disclosure, the step B111 may specifically include the following steps. The third voltage difference of the first sub pixel in the positive frame output by the output terminal of the voltage detection circuit during the positive frame driving is read, and the fourth voltage difference of the first sub pixel in the negative frame output by the output terminal of the voltage detection circuit during the negative frame driving is read. The input terminals of the voltage detection circuit are respectively coupled to the pixel electrode and the common electrode.

The voltage detection circuit is arranged in the liquid crystal display device in advance, and two input terminals of the voltage detection circuit are respectively coupled to the pixel electrode and the common electrode. The third voltage difference of the first sub pixel in the positive frame output by the output terminal of the voltage detection circuit is read during the positive frame driving; and the fourth voltage difference of the first sub pixel in the negative frame output by the output terminal of the voltage detection circuit is read during the negative frame driving.

Figure 6:
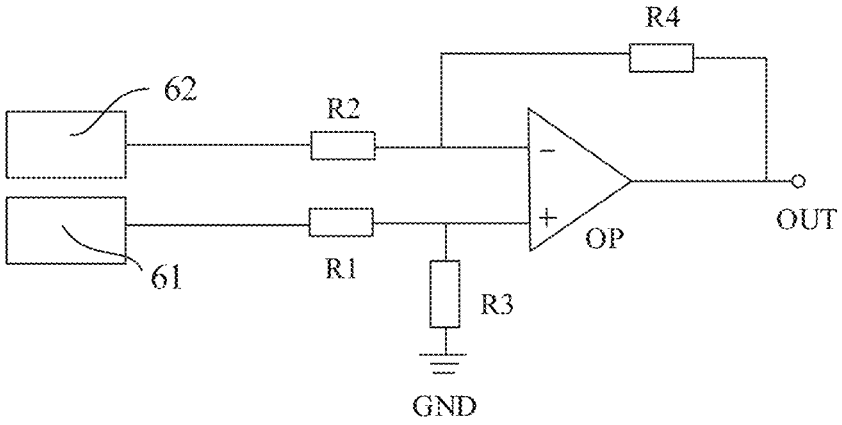
FIG. 6 is a schematic diagram of a voltage detection circuit according to an embodiment of the present disclosure.

The voltage detection circuit is substantially a subtraction circuit. As shown in FIG. 6, the voltage detection circuit includes a first resistor R1, a second resistor R2, a third resistor R3, a fourth resistor R4, and an amplifier OP. A first terminal of the first resistor R1 is coupled to the pixel electrode 61, and a second terminal of the first resistor R1 is coupled to a first input terminal of the amplifier OP. A first terminal of the second resistor R2 is coupled to the common electrode 62, and a second terminal of the second resistor R2 is coupled to a second input terminal of the amplifier OP. A first terminal of the third resistor R3 is coupled to the second terminal of the first resistor R1, and a second terminal of the third resistor R3 is coupled to the ground GND. A first terminal of the fourth resistor R4 is coupled to the second terminal of the second resistor R2, and a second terminal of the fourth resistor R4 is coupled to the output terminal OUT of the amplifier OP.

The resistances of the first resistor R1, the second resistor R2, the third resistor R3 and the fourth resistor R4 can be equal.

During the positive frame driving, the original pixel voltage in the positive frame on the pixel electrode 61 and the common voltage on the common electrode 62 are input to the voltage detection circuit, and the voltage detection circuit may output the voltage difference between the original pixel voltage in the positive frame and the common voltage. The absolute value of the voltage difference between the original pixel voltage in the positive frame and the common voltage is the third voltage difference. During the negative frame driving, the original pixel voltage in the negative frame on the pixel electrode 61 and the common voltage on the common electrode 62 are input to the voltage detection circuit, and the voltage detection circuit may output the voltage difference between the original pixel voltage in the negative frame and the common voltage. The absolute value of the voltage difference between the original pixel voltage in the positive frame and the common voltage is the fourth voltage difference.

In the embodiment of the disclosure, the detection that whether the absolute value of the difference between the first gray scale data of the first sub pixel and the second gray scale data of the second sub pixel in the static picture area of the image to be displayed is larger than the preset gray scale threshold is performed. If so, the first gray scale data is acquired, and the driving circuit is controlled to input the target data voltage to the data line coupled to the first sub pixel according to the first gray scale data, so as to adjust the original pixel voltage originally to be charged to the first sub pixel into the target pixel voltage, and to cause the absolute value of the voltage difference between the first voltage difference of the first sub pixel in the positive frame and the second voltage difference of the first sub pixel in the negative frame, to be smaller than the preset voltage difference threshold. The data voltage input to the data line coupled to the first sub pixel is corrected by detecting the first gray scale data where the abrupt change of the gray scale appears, such that the deviation between the first voltage difference and the second voltage difference is smaller than the preset voltage difference threshold. The first voltage difference is the voltage difference between the target pixel voltage of the first sub pixel on the pixel electrode and the common voltage on the common electrode during the positive frame driving, and the second voltage difference is the voltage difference between the target pixel voltage of the first sub pixel on the pixel electrode and the common voltage on the common electrode during the negative frame driving.

Figure 7:
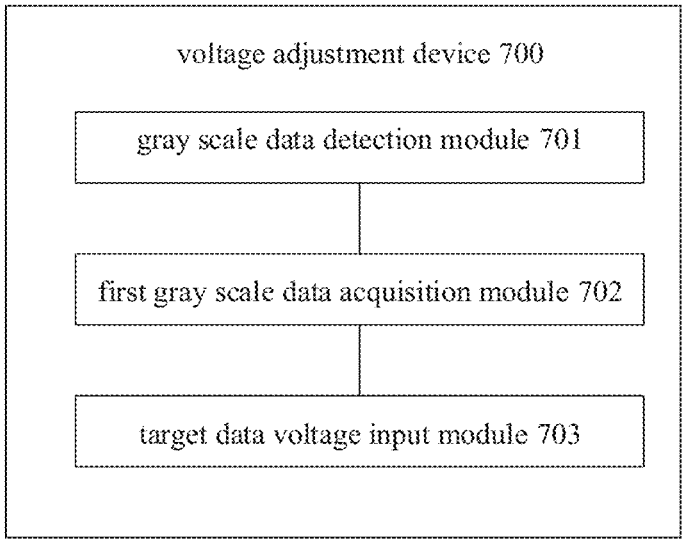
FIG. 7 is a block diagram of a voltage adjustment device according to an embodiment of the present disclosure.

FIG. 7 is a block diagram of a voltage adjustment device according to an embodiment of the present disclosure. The voltage adjustment device 700 includes a memory and a processor. Instructions are stored on the memory and executable on the processor. When executed by the processor, the instructions cause the processor to perform the method above.

The voltage adjustment device may be specifically implemented through the following functional modules: a gray scale data detection module 701, a first gray scale data acquisition module 702 and a target data voltage input module 703. The gray scale data detection module 701, the first gray scale data acquisition module 702, and the target data voltage input module 703 may be implemented in a software manner.

The gray scale data detection module 701 is configured to detect whether the absolute value of the difference between the first gray scale data of the first sub pixel and the second gray scale data of the second sub pixel in the static picture area of the image to be displayed is larger than the preset gray scale threshold. The first sub pixel and the second sub pixel are driven by the same data line and are arranged adjacent to each other. The first gray scale data acquisition module 702 is configured to acquire the first gray scale data when the absolute value of the difference between the first gray scale data of the first sub pixel and the second gray scale data of the second sub pixel is larger than the preset gray scale threshold. The target data voltage input module 703 is configured to control the driving circuit to input the target data voltage to the data line coupled to the first sub pixel according to the first gray scale data, so as to adjust the original pixel voltage to be theoretically charged to the first sub pixel into the target pixel voltage, and to cause the absolute value of the difference between the first voltage difference of the first sub pixel in the positive frame and the second voltage difference of the first sub pixel in the negative frame, to be smaller than the preset voltage difference threshold. The first voltage difference is the absolute value of the voltage difference between the target pixel voltage of the first sub pixel in the positive frame and the common voltage, and the second voltage difference is the absolute value of the voltage difference between the target pixel voltage of the first sub pixel in the negative frame and the common voltage.

The target data voltage input module 703 is further configured: to adjust one of the first gray scale data of the first sub pixel in the negative frame and the first gray scale data of the first sub pixel in the positive frame by taking the other one of the first gray scale data of the first sub pixel in the negative frame and the first gray scale data of the first sub pixel in the positive frame as a reference, so as to cause the absolute value of the difference between the first voltage difference of the first sub pixel in the positive frame and the second voltage difference of the first sub pixel in the negative frame to be smaller than the preset voltage difference threshold. That is, the absolute value of the voltage difference between the first voltage difference of the first sub pixel in the positive frame and the second voltage difference of the first sub pixel in the negative frame is smaller than the preset voltage difference threshold by adjusting only the gray scale data of one of the first sub pixel in the positive frame or the first sub pixel in the negative frame.

Figure 8:
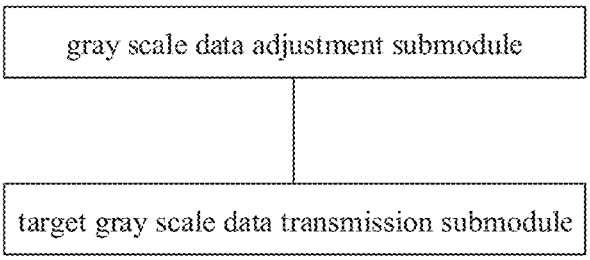
FIG. 8 is a block diagram illustrating a target data voltage input module according to an embodiment of the disclosure.

Optionally, FIG. 8 illustrates a block diagram of a target data voltage input module according to an embodiment of the disclosure. As shown in FIG. 8, the target data voltage input module 703 includes a gray scale data adjustment submodule and a target gray scale data transmission submodule.

The gray scale data adjustment submodule is configured to acquire the target gray scale data according to the first gray scale data of the first sub pixel in the negative frame. The target gray scale data transmission submodule is configured to send the target gray scale data to the driving circuit, so as to input the target data voltage in the negative frame by the driving circuit to the data line coupled to the first sub pixel. The original data voltage in the negative frame corresponding to the first gray scale data in the negative frame is not equal to the target data voltage in the negative frame.

Figure 9:
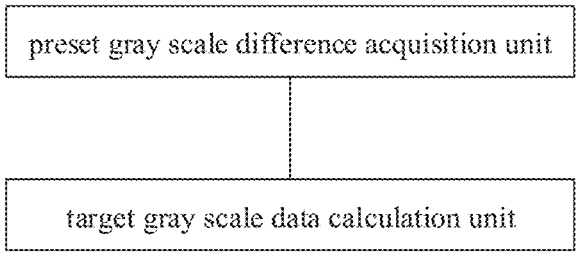
FIG. 9 is a block diagram illustrating a gray scale data adjustment submodule according to an embodiment of the present disclosure.

Optionally, FIG. 9 illustrates a block diagram of a gray scale data adjustment submodule according to an embodiment of the disclosure. As shown in FIG. 9, the gray scale data adjustment submodule includes a preset gray scale difference acquisition unit and a target gray scale data calculation unit. The preset gray scale difference value acquisition unit is configured to acquire the preset gray scale difference, and the preset gray scale difference value is a positive integer greater than 0. The target gray scale data calculation unit is configured to subtract the preset gray scale difference from the first gray scale data in the negative frame to acquire the target gray scale data.

Figure 10:
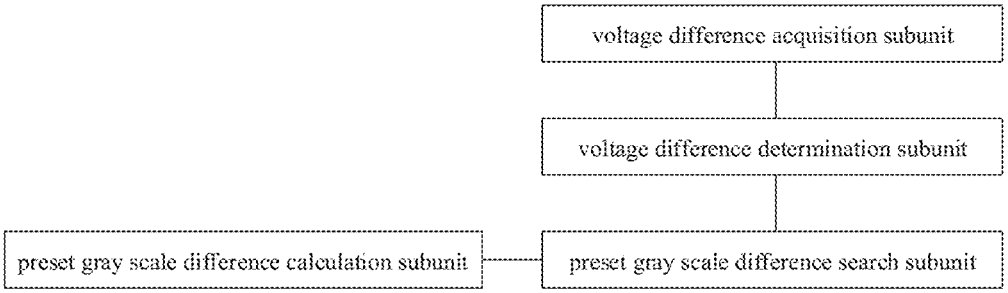
FIG. 10 is a block diagram illustrating a preset gray scale difference acquisition unit according to an embodiment of the disclosure.

Optionally, FIG. 10 illustrates a block diagram of a preset gray scale difference acquisition unit according to an embodiment of the disclosure. As shown in FIG. 10, the preset gray scale difference acquisition unit includes a voltage difference acquisition subunit, a voltage difference determination subunit, and a preset gray scale difference search subunit.

The voltage difference acquisition subunit is configured to acquire the third voltage difference of the first sub pixel in the positive frame and the fourth voltage difference of the first sub pixel in the negative frame. The third voltage difference is the absolute value of the voltage difference between the original pixel voltage of the first sub pixel in the positive frame and the common voltage, and the fourth voltage difference is the absolute value of the voltage difference between the original pixel voltage of the first sub pixel in the negative frame and the common voltage. The voltage difference value determination subunit is configured to determine the voltage difference of the first sub pixel in the positive frame and the first sub pixel in the negative frame according to the absolute value of the voltage difference between the third voltage difference and the fourth voltage difference. The preset gray scale difference value search subunit is configured to search the corresponding preset gray scale difference from the preset gray scale table according to the voltage difference of the first sub pixel in the positive frame and the first sub pixel in the negative frame. The preset gray scale table includes: a one-to-one correspondence of voltage differences between the first sub pixel in the positive frame and the first sub pixel in the negative frame, and preset gray scale differences corresponding to the voltage differences between the first sub pixel in the positive frame and the first sub pixel in the negative frame.

Optionally, as shown in FIG. 10, the preset gray scale difference acquisition unit further includes a preset gray scale difference calculation subunit. The preset gray scale difference calculation subunit is configured: to acquire the target data voltage of the first sub pixel in the negative frame, according to the voltage difference of the first sub pixel in the positive frame and the first sub pixel in the negative frame and the original pixel voltage of the first sub pixel in the negative frame; to determine the gray scale data corresponding to the target data voltage of the first sub pixel in the negative frame according to the correspondence relationship of voltage-grayscale, based on the target data voltage of the first sub pixel in the negative frame; to determine the gray scale data corresponding to the original pixel voltage of the first sub pixel in the negative frame according to the correspondence relationship of voltage-grayscale, based on the original pixel voltage of the first sub pixel in the negative frame; and to acquire the preset gray scale difference according to the gray scale data corresponding to the original pixel voltage of the first sub pixel in the negative frame and the gray scale data corresponding to the target data voltage of the first sub pixel in the negative frame.

Optionally, the voltage difference acquisition subunit is specifically configured: to determine the first charging current according to the gate-source voltage of the driving transistor corresponding to the first sub pixel in the positive frame, and to determine the second charging current according to the gate-source voltage of the driving transistor corresponding to the first sub pixel in the negative frame; to determine the third voltage difference of the first sub pixel in the positive frame according to the first charging current and the charging duration of the first sub pixel in each row, and to determine the fourth voltage difference of the first sub pixel in the negative frame according to the second charging current and the charging duration of the first sub pixel in each row.

Optionally, the voltage difference acquisition subunit is specifically configured to: read the third voltage difference of the first sub pixel in the positive frame output by the output terminal of the voltage detection circuit during the positive frame driving, and the fourth voltage difference of the first sub pixel in the negative frame output by the output terminal of the voltage detection circuit during the negative frame driving. The input terminals of the voltage detection circuit are respectively coupled to the pixel electrode and the common electrode.

In the embodiment of the disclosure, the data voltage input to the data line coupled to the first sub pixel is corrected by detecting the first gray scale data where the abrupt change of the gray scale appears, such that the deviation between the voltage difference, which is between the target pixel voltage of the first sub pixel in the positive frame on the pixel electrode and the common voltage on the common electrode during the positive frame driving, and the voltage difference, which is between the target pixel voltage of the first sub pixel in the negative frame on the pixel electrode and the common voltage on the common electrode during the positive frame driving, is smaller than the preset voltage difference threshold, thereby avoiding the residual image.

The embodiment of the present disclosure further provides a display device including the above voltage adjustment device. The voltage adjustment device is arranged in a TCON (Timer Control Register). Of course, the display device further includes a liquid crystal display panel and a driving circuit for driving the liquid crystal display panel to perform display.

In practice, the display device may be: any product or component with a display function, such as a mobile phone, a tablet computer, a display, a notebook computer, a navigator and the like.

In the embodiment of the disclosure, the data voltage input to the data line coupled to the first sub pixel is corrected by detecting the first gray scale data where the abrupt change of the gray scale appears, such that the deviation between the voltage difference, which is between the target pixel voltage of the first sub pixel in the positive frame on the pixel electrode and the common voltage on the common electrode during the positive frame driving, and the voltage difference, which is between the target pixel voltage of the first sub pixel in the negative frame on the pixel electrode and the common voltage on the common electrode during the positive frame driving, is smaller than the preset voltage difference threshold, thereby avoiding the residual image.

The flowchart and block diagrams in the figures illustrate the architecture, functionality, and operation of possible implementations of systems, methods and computer program products according to various embodiments of the present disclosure. In this regard, each block in the flowchart or block diagrams may represent a module, segment, or portion of code, which includes at least one executable instruction for implementing the specified logical function(s). It should also be noted that, in some alternative implementations, the functions noted in the block may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The units or modules involved in the embodiments of the present disclosure may be implemented by software or hardware. The described units or modules may also be provided in a processor, for example, each of the described units may be a software program provided in a computer or a mobile intelligent device, or may be a separately configured hardware device. The designation of such a unit or module does not in some way constitute a limitation on the unit or module itself.

For simplicity of explanation, the foregoing method embodiments are presented as a series of acts or combinations, but it should be appreciated by those skilled in the art that the present disclosure is not limited by the order of acts, as some steps may occur in other orders or concurrently in accordance with the present disclosure. Further, those skilled in the art will appreciate that the embodiments described in the specification are preferred embodiments and that the acts and circuits described are not necessary to the disclosure.

The embodiments in the present specification are all described in a progressive manner, and each embodiment focuses on differences from other embodiments, and portions that are the same and similar between the embodiments may be referred to each other.

Finally, it should also be noted that, in this document, relational terms such as first and second, and the like are used solely to distinguish one entity or action from another entity or action without necessarily requiring or implying any actual such relationship or order between such entities or actions. Also, the terms "includes," "including," or any other variation thereof, are intended to cover a non-exclusive inclusion, such that a process, method, article, or apparatus that includes a list of elements does not include only those elements but may include other elements not expressly listed or inherent to such process, method, article, or apparatus. Without further limitation, an element defined by the phrase "including an . . . " does not exclude the presence of other identical elements in the process, method, article, or apparatus that includes the element.

The voltage adjustment method, the voltage adjustment device and the display device provided by the present disclosure are introduced in detail, and specific examples are applied in the text to explain the principles and the implementation of the present disclosure, and the description of the above embodiments is only used to help to understand the method and the inventive concept of the present disclosure; meanwhile, for a person skilled in the art, according to the idea of the present disclosure, there may be variations in the specific embodiments and the application scope, and in summary, the content of the present specification should not be construed as a limitation to the present disclosure.

What is claimed is:

1. A voltage adjustment method for a display panel, comprising:

detecting whether an absolute value of a difference between a first gray scale data of a first sub pixel and a second gray scale data of a second sub pixel is larger than a preset gray scale threshold, wherein the first gray scale data of the first sub pixel and the second gray scale data of the second sub pixel are in a static picture area of a same image to be displayed, and the first sub pixel and the second sub pixel are driven by a same data line and are arranged adjacent to each other;

acquiring the first gray scale data when the absolute value of the difference between the first gray scale data of the first sub pixel and the second gray scale data of the second sub pixel is larger than the preset gray scale threshold; and inputting a target data voltage to the data line coupled to the first sub pixel according to the first gray scale data, so as to adjust an original pixel voltage to be theoretically charged to the first sub pixel into a target pixel voltage and to cause an absolute value of a voltage difference between a first voltage difference of the first sub pixel in a positive frame and a second voltage difference of the first sub pixel in a negative frame, to be smaller than a preset voltage difference threshold;

wherein the first voltage difference is an absolute value of a voltage difference between the target pixel voltage of the first sub pixel in the positive frame and a common voltage, and the second voltage difference is an absolute value of a voltage difference between the target pixel voltage of the first sub pixel in the negative frame and the common voltage, wherein the positive frame and the negative frame are two adjacent frames during which polarities of voltages applied to liquid crystal molecules are opposite to each other; and the original data voltage of the first sub pixel in only the positive frame is adjusted to the target data voltage in the positive frame, so that the original pixel voltage in the positive frame is adjusted to the target pixel voltage in the positive frame, while the target pixel voltage in the negative frame is equal to the original pixel voltage in the negative frame, wherein the first voltage difference is greater than an absolute value of a voltage difference between the original pixel voltage in the positive frame and the common voltage; or the original data voltage of the first sub pixel in only the negative frame is adjusted to the target data voltage in the negative frame, so that the original pixel voltage in the negative frame is adjusted to the target pixel voltage in the negative frame, while the target pixel voltage in the positive frame is equal to the original pixel voltage in the positive frame, the second voltage difference is less than an absolute value of a voltage difference between the original pixel voltage in the positive frame and the common voltage, wherein the absolute value of the voltage difference between the target pixel voltage of the first sub pixel in the positive frame and the common voltage during the positive frame driving is equal to the absolute value of the voltage difference between the target pixel voltage of the first sub pixel in the negative frame and the common voltage during the negative frame driving.

2. The method of claim 1, wherein the inputting the target data voltage to the data line coupled to the first sub pixel according to the first gray scale data comprises:

adjusting one of the first gray scale data of the first sub pixel in the negative frame and the first gray scale data of the first sub pixel in the positive frame by taking the other one of the first gray scale data of the first sub pixel in the negative frame and the first gray scale data of the first sub pixel in the positive frame as a reference, so as to cause the absolute value of the voltage difference between the first voltage difference of the first sub pixel in the positive frame and the second voltage difference of the first sub pixel in the negative frame, to be smaller than the preset voltage difference threshold.

3. The method of claim 2, wherein the inputting the target data voltage to the data line coupled to the first sub pixel according to the first gray scale data further comprises:

acquiring a target gray scale data of the first sub pixel in the negative frame according to the first gray scale data of the first sub pixel in the negative frame; and inputting a target data voltage of the first sub pixel in the negative frame corresponding to the target gray scale data of the first sub pixel in the negative frame, to the data line coupled to the first sub pixel;

wherein an original data voltage of the first sub pixel in the negative frame corresponding to the first gray scale data of the first sub pixel in the negative frame is not equal to the target data voltage of the first sub pixel in the negative frame.

4. The method of claim 3, wherein the original data voltage of the first sub pixel in the negative frame corresponding to the first gray scale data of the first sub pixel in the negative frame is smaller than the target data voltage of the first sub pixel in the negative frame.

5. The method of claim 4, wherein the acquiring the target gray scale data of the first sub pixel in the negative frame according to the first gray scale data of the first sub pixel in the negative frame comprises:

acquiring a preset gray scale difference according to the first gray scale data of the first sub pixel in the negative frame, wherein the preset gray scale difference is a positive integer greater than 0; and subtracting the preset gray scale difference from the first gray scale data of the first sub pixel in the negative frame to acquire the target gray scale data of the first sub pixel in the negative frame.

6. The method of claim 5, wherein the acquiring the preset gray scale difference comprises:

acquiring a third voltage difference of the first sub pixel in the positive frame and a fourth voltage difference of the first sub pixel in the negative frame, wherein the third voltage difference is an absolute value of a voltage difference between the original pixel voltage of the first sub pixel in the positive frame and the common voltage, and the fourth voltage difference is an absolute value of a voltage difference between the original pixel voltage of the first sub pixel in the negative frame and the common voltage;

determining a voltage difference between the first sub pixel in the positive frame and the first sub pixel in the negative frame, according to an absolute value of a voltage difference between the third voltage difference and the fourth voltage difference; and searching a corresponding preset gray scale difference from a preset gray scale table, according to the voltage difference between the first sub pixel in the positive frame and the first sub pixel in the negative frame;

wherein the preset gray scale table comprises: a one-to-one correspondence of voltage differences between the first sub pixel in the positive frame and the first sub pixel in the negative frame, and preset gray scale differences corresponding to the voltage differences between the first sub pixel in the positive frame and the first sub pixel in the negative frame.

7. The method of claim 6, wherein the acquiring the preset gray scale difference further comprises:

acquiring the target data voltage of the first sub pixel in the negative frame, according to the voltage difference between the first sub pixel in the positive frame and the first sub pixel in the negative frame, and the original pixel voltage of the first sub pixel in the negative frame;

determining the gray scale data corresponding to the target data voltage of the first sub pixel in the negative frame, according to correspondence relationship of voltage-grayscale, based on the target data voltage of the first sub pixel in the negative frame;

determining the gray scale data corresponding to the original pixel voltage of the first sub pixel in the negative frame, according to the correspondence relationship of voltage-grayscale, based on the original pixel voltage of the first sub pixel in the negative frame; and acquiring the preset gray scale difference according to the gray scale data corresponding to the original pixel voltage of the first sub pixel in the negative frame and the gray scale data corresponding to the target data voltage of the first sub pixel in the negative frame.

8. The method of claim 7, wherein the acquiring the third voltage difference of the first sub pixel in the positive frame and the fourth voltage difference of the first sub pixel in the negative frame comprises:

determining a first charging current according to a gate-source voltage of a driving transistor in the first sub pixel in the positive frame, and determining a second charging current according to the gate-source voltage of the driving transistor in the first sub pixel in the negative frame; and determining the third voltage difference of the first sub pixel in the positive frame according to the first charging current and a charging duration of the sub pixels in each row, and determining the fourth voltage difference of the first sub pixel in the negative frame according to the second charging current and the charging duration of the sub pixels in each row.

9. The method of claim 7, wherein the acquiring the third voltage difference of the first sub pixel in the positive frame and the fourth voltage difference of the first sub pixel in the negative frame comprises:

reading the third voltage difference of the first sub pixel in the positive frame output by an output terminal of a voltage detection circuit during a positive frame driving, and the fourth voltage difference of the first sub pixel in the negative frame output by the output terminal of the voltage detection circuit during a negative frame driving, wherein input terminals of the voltage detection circuit are respectively coupled to a pixel electrode and a common electrode.

10. A voltage adjustment device for a display panel, comprising a memory and a processor, wherein instructions are stored on the memory and executable on the processor, and when executed by the processor, the instructions cause the processor to perform a method comprising:

detecting whether an absolute value of a difference between a first gray scale data of a first sub pixel and a second gray scale data of a second sub pixel is larger than a preset gray scale threshold, wherein the first gray scale data of the first sub pixel and the second gray scale data of the second sub pixel are in a static picture area of a same image to be displayed, and the first sub pixel and the second sub pixel are driven by a same data line and are arranged adjacent to each other;

acquiring the first gray scale data when the absolute value of the difference between the first gray scale data of the first sub pixel and the second gray scale data of the second sub pixel is larger than the preset gray scale threshold; and inputting a target data voltage to the data line coupled to the first sub pixel according to the first gray scale data, so as to adjust an original pixel voltage to be theoretically charged to the first sub pixel into a target pixel voltage and to cause an absolute value of a voltage difference between a first voltage difference of the first sub pixel in a positive frame and a second voltage difference of the first sub pixel in a negative frame, to be smaller than a preset voltage difference threshold;

wherein the first voltage difference is an absolute value of a voltage difference between the target pixel voltage of the first sub pixel in the positive frame and a common voltage, and the second voltage difference is an absolute value of a voltage difference between the target pixel voltage of the first sub pixel in the negative frame and the common voltage, wherein the positive frame and the negative frame are two adjacent frames during which polarities of voltages applied to liquid crystal molecules are opposite to each other; and the original data voltage of the first sub pixel in only the positive frame is adjusted to the target data voltage in the positive frame, so that the original pixel voltage in the positive frame is adjusted to the target pixel voltage in the positive frame, while the target pixel voltage in the negative frame is equal to the original pixel voltage in the negative frame, wherein the first voltage difference is greater than an absolute value of a voltage difference between the original pixel voltage in the positive frame and the common voltage; or the original data voltage of the first sub pixel in only the negative frame is adjusted to the target data voltage in the negative frame, so that the original pixel voltage in the negative frame is adjusted to the target pixel voltage in the negative frame, while the target pixel voltage in the positive frame is equal to the original pixel voltage in the positive frame, the second voltage difference is less than an absolute value of a voltage difference between the original pixel voltage in the positive frame and the common voltage, wherein the absolute value of the voltage difference between the target pixel voltage of the first sub pixel in the positive frame and the common voltage during the positive frame driving is equal to the absolute value of the voltage difference between the target pixel voltage of the first sub pixel in the negative frame and the common voltage during the negative frame driving.

11. The voltage adjustment device for a display panel of claim 10, wherein the inputting the target data voltage to the data line coupled to the first sub pixel according to the first gray scale data comprises:

adjusting one of the first gray scale data of the first sub pixel in the negative frame and the first gray scale data of the first sub pixel in the positive frame by taking the other one of the first gray scale data of the first sub pixel in the negative frame and the first gray scale data of the first sub pixel in the positive frame as a reference, so as to cause the absolute value of the voltage difference between the first voltage difference of the first sub pixel in the positive frame and the second voltage difference of the first sub pixel in the negative frame, to be smaller than the preset voltage difference threshold.

12. The voltage adjustment device for a display panel of claim 11, wherein the inputting the target data voltage to the data line coupled to the first sub pixel according to the first gray scale data further comprises:

acquiring a target gray scale data of the first sub pixel in the negative frame according to the first gray scale data of the first sub pixel in the negative frame; and inputting a target data voltage of the first sub pixel in the negative frame, corresponding to the target gray scale data of the first sub pixel in the negative frame, to the data line coupled to the first sub pixel;

wherein an original data voltage of the first sub pixel in the negative frame corresponding to the first gray scale data of the first sub pixel in the negative frame is not equal to the target data voltage of the first sub pixel in the negative frame.

13. The voltage adjustment device for a display panel of claim 12, wherein the original data voltage of the first sub pixel in the negative frame corresponding to the first gray scale data of the first sub pixel in the negative frame is smaller than the target data voltage of the first sub pixel in the negative frame.

14. The voltage adjustment device for a display panel of claim 13, wherein the acquiring the target gray scale data of the first sub pixel in the negative frame according to the first gray scale data of the first sub pixel in the negative frame comprises:

acquiring a preset gray scale difference according to the first gray scale data of the first sub pixel in the negative frame, wherein the preset gray scale difference is a positive integer greater than 0; and subtracting the preset gray scale difference from the first gray scale data of the first sub pixel in the negative frame to acquire the target gray scale data of the first sub pixel in the negative frame.

15. The voltage adjustment device for a display panel of claim 14, wherein the acquiring the preset gray scale difference according to the first gray scale data of the first sub pixel in the negative frame comprises:

acquiring a third voltage difference of the first sub pixel in the positive frame and a fourth voltage difference of the first sub pixel in the negative frame, wherein the third voltage difference is an absolute value of a voltage difference between the original pixel voltage of the first sub pixel in the positive frame and the common voltage, and the fourth voltage difference is an absolute value of a voltage difference between the original pixel voltage of the first sub pixel in the negative frame and the common voltage;

determining a voltage difference between the first sub pixel in the positive frame and the first sub pixel in the negative frame, according to an absolute value of a voltage difference between the third voltage difference and the fourth voltage difference; and searching a corresponding preset gray scale difference from a preset gray scale table, according to the voltage difference between the first sub pixel in the positive frame and the first sub pixel in the negative frame;

wherein the preset gray scale table comprises: a one-to-one correspondence of voltage differences between the first sub pixel in the positive frame and the first sub pixel in the negative frame, and preset gray scale differences corresponding to the voltage differences between the first sub pixel in the positive frame and the first sub pixel in the negative frame.

16. The voltage adjustment device for a display panel of claim 15, wherein the acquiring the preset gray scale difference according to the first gray scale data in the negative frame further comprises:

acquiring the target data voltage of the first sub pixel in the negative frame, according to the voltage difference, between the first sub pixel in the positive frame and the first sub pixel in the negative frame, and the original pixel voltage of the first sub pixel in the negative frame;

determining the gray scale data corresponding to the target data voltage of the first sub pixel in the negative frame, according to correspondence relationship of voltage-grayscale based on the target data voltage of the first sub pixel in the negative frame;

determining the gray scale data corresponding to the original pixel voltage of the first sub pixel in the negative frame, according to the correspondence relationship of voltage-grayscale, based on the original pixel voltage of the first sub pixel in the negative frame; and acquiring the preset gray scale difference according to the gray scale data corresponding to the original pixel voltage of the first sub pixel in the negative frame and the gray scale data corresponding to the target data voltage of the first sub pixel in the negative frame.

17. The voltage adjustment device for a display panel of claim 16, wherein the acquiring the third voltage difference of the first sub pixel in the positive frame and the fourth voltage difference of the first sub pixel in the positive frame comprises:

determining a first charging current according to a gate-source voltage of a driving transistor in the first sub pixel in the positive frame, and determining a second charging current according to a gate-source voltage of the driving transistor in the first sub pixel in the negative frame; and determining the third voltage difference of the first sub pixel in the positive frame according to the first charging current and a charging duration of the sub pixels in each row, and determining the fourth voltage difference of the first sub pixel in the negative frame according to the second charging current and the charging duration of the sub pixels in each row.

18. The voltage adjustment device for a display panel of claim 16, wherein the acquiring the third voltage difference of the first sub pixel in the positive frame and the fourth voltage difference of the first sub pixel in the negative frame comprises:

reading the third voltage difference of the first sub pixel in the positive frame output by an output terminal of a voltage detection circuit during a positive frame driving, and the fourth voltage difference of the first sub pixel in the negative frame output by the output terminal of the voltage detection circuit during a negative frame driving, wherein input terminals of the voltage detection circuit are respectively coupled to a pixel electrode and a common electrode.

19. A display device comprising a display panel and the voltage adjustment device for the display panel of claim 10.

20. The display device of claim 19, further comprising a driving circuit for driving the display panel to perform display.

* * * * *